US005904116A

United States Patent [19]

Wyner et al.

[11] Patent Number: 5,904,116

[45] Date of Patent: May 18, 1999

[54] REVOLVING PENNANT

[76] Inventors: Stewart A. Wyner; Donna M. Purcell, both of 10987 Jackson Rd., Sacramento, Calif. 95830

[21] Appl. No.: 08/859,886

[22] Filed: May 21, 1997

[51] Int. Cl.[6] ..... G09F 17/00

[52] U.S. Cl. ..... 116/173; 40/586

[58] Field of Search ..... 40/586; 116/173, 116/174, 175, 209

[56] References Cited

U.S. PATENT DOCUMENTS

| | | | |
|---|---|---|---|
| 1,298,550 | 3/1919 | Newel | 116/174 |
| 1,311,712 | 7/1919 | Power | 116/174 |
| 1,801,518 | 4/1931 | Matteson | 116/174 |
| 2,368,783 | 2/1945 | Schillinger | 116/174 |
| 2,869,507 | 1/1959 | Boyer | 116/173 |
| 3,395,577 | 8/1968 | Keim | 73/188 |
| 4,057,030 | 11/1977 | Womack | 116/175 |
| 4,144,833 | 3/1979 | Newman, Sr. | 116/173 X |
| 5,335,621 | 8/1994 | Willis et al. | 116/173 |
| 5,375,555 | 12/1994 | Dolan | 116/174 |
| 5,522,342 | 6/1996 | Chen-Chao | 116/174 |

*Primary Examiner*—Richard Chilcot
*Assistant Examiner*—Willie Morris Worth
*Attorney, Agent, or Firm*—Heisler & Associates

[57] ABSTRACT

A revolving pennant 10 is provided which features a flag 20 which is attached to a handle 40 through a pivot assembly 50. The pivot assembly 50 connects the flag 20 to the handle 40 in a manner which allows the flag 20 to revolve around the handle 40 without furling. A weight region 30 is oriented upon the flag 20 to enhance an ease with which the flag 20 can be caused to revolve about the handle 40. The pivot assembly 50 includes an axle 52 attached to the handle 40 and a collar 60 surrounding the axle 52 and to which the flag 20 is attached. The collar 60 is maintained upon the axle 52 by a cap 54 and disc 57 which are oriented at ends of the axle 52 and spaced from each other, restricting travel of the collar 60 and preventing the collar 60 from falling off of the handle 40.

1 Claim, 2 Drawing Sheets

REVOLVING PENNANT

FIELD OF THE INVENTION

The following invention relates to pennants such as those which are used by spectators at sporting events to cheer for participants. More specifically, this invention relates to pennants which include a flag portion and a handle portion, the flag portion being connected to the handle portion in a manner which allows the flag portion to easily revolve without furling around the handle.

BACKGROUND OF THE INVENTION

Spectators at sporting events often prefer to become involved in the event they are watching by shouting and waving objects such as pennants. Typical pennants include a stick with a planar flexible flag portion attached to the stick. The stick is generally linear and the flag portion can be any of a variety of different shapes with bright colors and words printed upon the flag portion. Typically, a name of the team of participants for which the spectator has a preference is printed upon the flag and the colors utilized on the flag portion match those of the players for the team for which the spectator is rooting. When the spectator wishes to cheer for the team for which the spectator has a preference, the spectator will typically hold the pennant up in the air and wave the stick back and forth, causing the flag portion of the pennant to wave back and forth in an oscillating pattern. This activity is frequently accompanied with shouting, standing and applause.

At some sporting events, the standard pennant has been replaced by spectators with a towel. The towel will typically have the colors and words printed thereon similar to the flag portion of the pennant. The spectator holds one end of the towel with the towel wrapped or bunched up into a generally cylindrical form and then holds the towel over the spectator's head and waves the towel in a revolving fashion, such that the towel travels in a circular pattern over the spectator's head. When multiple spectators revolve towels together in unison, the spectator region of the grandstand can take on a distinctive appearance which tends to excite the performers at the sporting event and other fans in adjacent grandstands, tending to elevate an excitement level and an enjoyment level for all of the fans at the sporting event.

While pennants and towels are generally effective for the desired purpose of exciting other spectators and the performers, they do suffer from numerous drawbacks. Standard pennants are typically not attached to the stick portion in a manner which facilitates revolving of the flag portion of the pennant. Thus, the standard pennant can only be oscillated back and forth, rather than in a circular pattern. Even if oscillation is the only motion which the pennant performs, if the oscillation is too extreme, the flag portion of the pennant, if not securely attached to the stick, can come flying off of the stick. Also, the lack of any weight enhancement on any portions of the flag portion of the pennant make it difficult to cause the flag portion of the pennant to revolve about the stick. Similarly, the towel, lacking weights, is not easily rotated in a circular pattern over the head of a user without the spectator utilizing a high level of energy to keep the towel rotating and revolving over the spectator's head. Thus, periods of intense pennant and towel waving and revolving tend to be limited to short durations of time, diminishing their overall effectiveness. In addition, towels are not easily printed upon with high definition graphics, and hence, while revolvable over a spectator's head, typically the print upon the towel is not visually apparent during this process.

Accordingly, a need exists for a revolving pennant which can be easily revolved over the head of a user and which clearly displays the colors, logos and other indicia desired in a manner which is readily observable by other spectators and by the performers at a sporting event. Such a revolving banner would be lightweight, easily and safely used, and sized appropriately to not interfere with the enjoyment of other spectators nearby.

SUMMARY OF THE INVENTION

The revolving pennant of this invention includes a flag of planar flexible material attached to a handle of rigid elongate material. The flag is attached to the handle in a manner which allows the flag to revolve around the handle without furling against the handle. Rather, the flag can revolve indefinitely in either a clockwise or counter clockwise direction about the handle without binding. The flag is weighted at a region thereof spaced away from the portion which is adjacent to the handle. A weight is provided in this weight region which causes the flag to have a higher radius of gyration and a larger overall weight than would otherwise be the case, such that the flag can be more easily revolved about the handle.

A pivot assembly joins the flag to the handle and provides for rotation of the flag and attachment of the flag to the handle without an actual fixed attachment there between. The pivot assembly includes an axle attached to the handle and a collar attached to the flag. The collar is sized to surround the axle and is restrained from sliding off of ends of the axle. The collar has an inner surface which has a greater diameter than a diameter of the axle so that the collar can freely rotate around the axle. The flag is attached to the collar in a manner allowing the flag to rotate around the axle when the collar rotates. When a fan wishes to utilize the revolving pennant, the fan grasps the handle with a hand and causes an upper end of the handle to revolve in a generally circular pattern. The flag, being weighted and having a large radius of gyration, is caused to oscillate about the upper end of the handle and the pivot assembly when the handle is revolved. Printed words, colors, logos and other indicia upon the surfaces of the flag are readily observable as the flag is suspended generally in a horizontal planar configuration. while being rotated about the pivot assembly.

OBJECTS OF THE INVENTION

Accordingly, a primary object of the present invention is to provide a pennant which can revolve about a handle for use by a fan at a spectator event.

Another object of the present invention is to provide a pennant which can have words, logos or other indicia printed thereon and can have such indicia visible while the pennant is revolving about the handle.

Another object of the present invention is to provide a revolving pennant which is easily used by a fan without a great amount of energy, such that the revolving pennant can be used for long periods without rest.

Another object of the present invention is to provide a revolving pennant which features a pivot assembly which prevents a flag portion of the pennant from becoming furled around a handle portion of the pennant.

Another object of the present invention is to provide a revolving pennant which can be revolved around a handle in a safe manner without disrupting persons adjacent the fan utilizing the revolving pennant.

Another object of the present invention is to provide a revolving pennant which is of simple manufacture from readily available, low cost and durable materials.

Other further objects of the invention will become apparent from a careful reading of the included description and claims and from a review of the drawing figures included herein.

BRIEF DESCRIPTION OF THE DRAWING FIGURES

DETAILED DESCRIPTION OF THE PREFERRED EMBODIMENT

Figure 1:
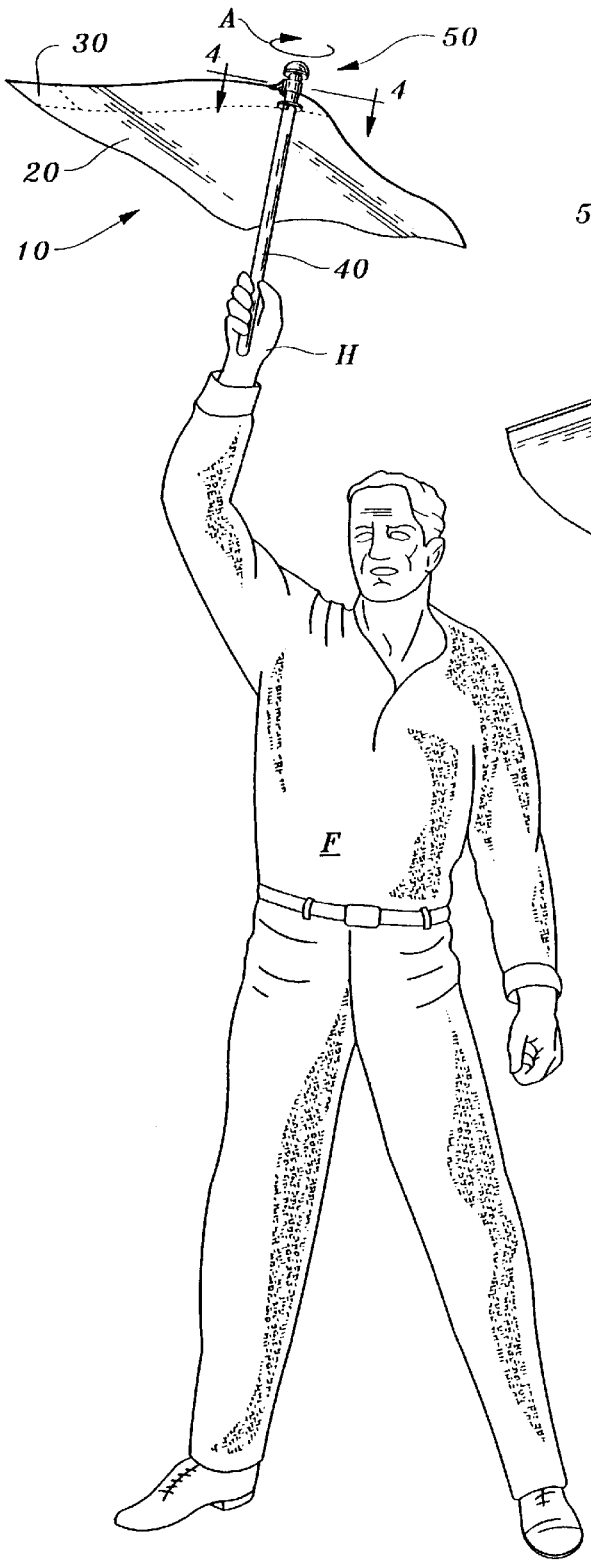
FIG. 1 is a perspective view of a fan grasping the revolving pennant of this invention and rotating the revolving pennant in a manner taught by this invention.

Referring to the drawings, wherein like reference numerals represent like parts throughout the various different drawing figures, reference numeral 10 is directed to a revolving pennant (FIG. 1). The revolving pennant 10 is utilizable in a hand H of a fan F to cheer for various different participants at a sporting event. A handle 40 which is grasped by the hand H of the fan F is oscillated in a revolving manner along arrow A, causing a flag 20 attached to the handle 40 to revolve around the handle 40.

In essence, and with particular reference to FIG. 1, the revolving pennant 10 includes a flag 20 of planar flexible material which features a weight region 30 at a particular location thereon. The flag 20 is attached to the handle 40 at a pivot assembly 50 between the handle 40 and the flag 20. The handle 40 is a rigid elongate structure which is preferably cylindrical. The pivot assembly 50 includes a collar 60 (FIG. 2) surrounding the handle 40 adjacent an upper end 46 of the handle 40 which defines an axle 52. A leash 70 passes through the collar 60 and is attached to the flag 20. The flag 20, leash 70 and collar 60 can all thus rotate about the axle 52 of the pivot assembly 50 and around the handle 40 as the handle 40 is oscillated in a revolving manner over the head of the fan F.

Figure 3:
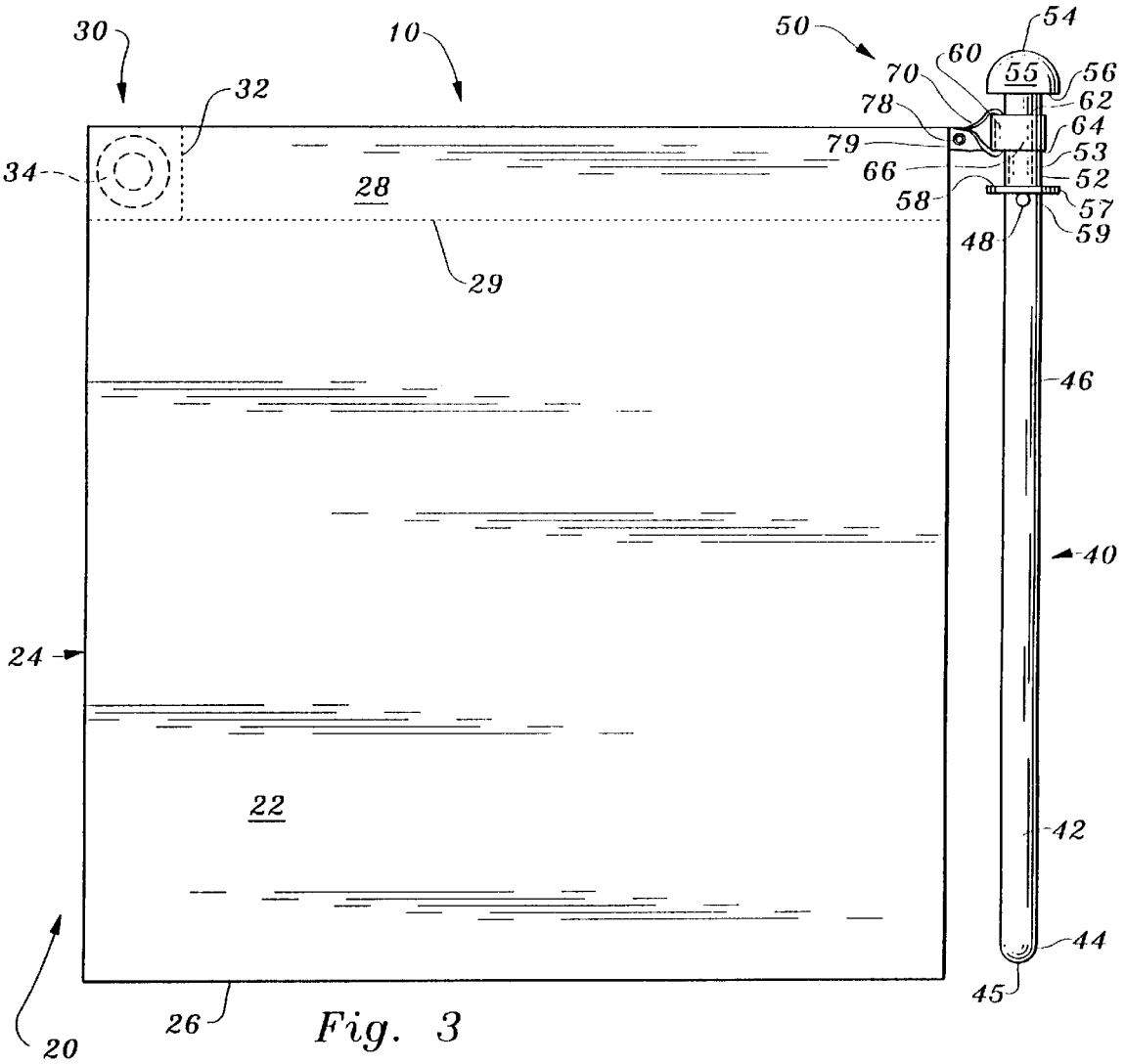
FIG. 3 is a front elevation view of the revolving pennant of this invention.

More specifically, and with particular reference to FIG. 3, details of the flag portion of the revolving pennant 10 are described. The flag 20 is a planar flexible piece of material which can be a variety of different shapes but is preferably rectangular or square. The flag 20 has a front surface 22 and rear surface 24 which are generally planar and parallel to each other. The front surface 22 and rear surface 24 can support various different printed material thereon, such as a name, logo or other indicia of a sports franchise or an amateur sports team, or a sponsor of a sports team or a sporting event. The printed material can either be printed onto the front surface 22 and rear surface 24 through a process such as silk screening, or it can be embroidered into the front surface 22 and rear surface 24, or some combination of these techniques or other techniques known in the prior art for printing upon planar surfaces can be used. The front surface 22 and rear surface 24 can either be printed with identical information or can be printed with different information between the front surface 22 and rear surface 24. A perimeter 26 defines a boundary of the flag 20 and a transition between the front surface 22 and rear surface 24. Preferably, the perimeter 26 is finished with a seam of some sort, to prevent fraying of material forming the flag 20.

Preferably, a top eighth of the flag 20 defines a reinforcement zone 28 at which additional fabric is utilized to form the flag 20. The reinforcement zone 28 is preferably rectangular and is defined at a lower edge thereof by a horizontal seam 29 and extends up to a top edge of the flag 20. The reinforcement zone 28 enhances a strength of the flag 20 between the weight region 30 and the pivot assembly 50, to decrease any possibility that the flag 20 would fail under tension loads exerted by the weight region 30, when the revolving pennant 10 is in use. One way to form the reinforcement zone 28 is by folding over a single piece of material forming the flag 20 and then sewing it back upon itself with the horizontal seam 29. If such a technique is used, a pocket is provided between the horizontal seam 29 and a top edge of the flag 20.

The flag 20 features a weight region 30 which enhances the ability of the flag 20 to be revolved about the handle 40 when the handle 40 itself is oscillated in a revolving manner by a fan F. The weight region 30 is preferably defined on a lower edge by the horizontal seam 29 and on a side facing the pivot assembly 50 by a vertical seam 32. Other boundaries of the weight region 30 are formed by portions of the perimeter 26 of the flag 20. If the reinforcement zone 28 of the flag 20 is formed by folding material forming the flag 20 back onto itself and then attaching it with the horizontal seam 29 to form a pocket, a weight 34 can be placed within this pocket and on a side of the vertical seam 32 spaced away from the pivot assembly 50. In this configuration the weight 34 cannot escape from within the weight region 30. Such a configuration prevents the weight 34 from escaping out of the weight region 30 and becoming a dangerous projectile and diminishing the effectiveness of the revolving pennant 10.

The weight 34 can be any of a variety of different constructs having the desired mass. For instance, a washer formed of a high density metal material, such as steel could be utilized. Preferably however, the weight 34 is constructed of a material such as a "bean" bag including high mass small pellets sewn within a sleeve. Such a bag of pellets would provide the desired mass and yet have a high amount of flexibility and deformability if the weight 34 escapes from the weight region 30 and becomes a projectile. Similarly, if the weight 34 is of a deformable character, such as the bag of pellets or sand, an amount of injury or damage caused by the revolving pennant 10 is reduced if it is caused to strike other spectators or property while still attached to the flag 20.

While the weight region 30 is preferably located in an upper corner of the flag 20 opposite the pivot assembly 50, the weight region 30 could be at any of a variety of different positions upon the flag 20, depending on the desired revolving characteristics of the flag 20. By placing the weight region 30 at a position along the upper edge of the flag 20 and spaced away from the pivot assembly 50, the flag 20 is provided with a fairly large radius of gyration. With a higher radius of gyration, the flag 20 is more easily maintained at a specific rate of revolution about the handle 40 and the fan F can more easily overcome aerodynamic drag forces which tend to slow down a rate of revolution of the flag 20 about the handle 40. Also, by placing the weight region 30 spaced away from the pivot assembly 50, the flag 20 is held in a generally taut configuration such that the flag 20 is generally planar when revolving about the handle 40. Thus, printed indicia upon the flag 20 can be readily observed and read by others even when the flag 20 is actively revolving about the handle 40.

With particular reference to FIG. 3, details of the handle 40 of the revolving pennant 10 are described. The handle 40 is preferably an elongate rigid cylindrical construct. Preferably, the handle 40 is formed from a high density plastic which resists fracture, but which remains essentially rigid when loads such as those generated by revolving of the flag 20 about the handle 40 are applied upon the handle 40. The handle 40 is preferably cylindrical with the cylindrical surface 42 defining a surface of the handle 40. This cylindrical surface 42 is of a diameter which facilitates easy grasping by a fan F with a hand H. A lower end 44 of the handle 40 is provided with a dome 45 such that the handle 40 can be comfortably held adjacent the lower end 44. The upper end 46 opposite the lower end 44 supports the pivot assembly 50 thereon. Preferably, the upper end 46 is spaced from the lower end 44 by a distance of approximately 1½ feet. However, this distance between the upper end 46 and lower end 44 could be drastically increased or reduced depending on the desired configuration for the revolving pennant 10.

Figure 2:
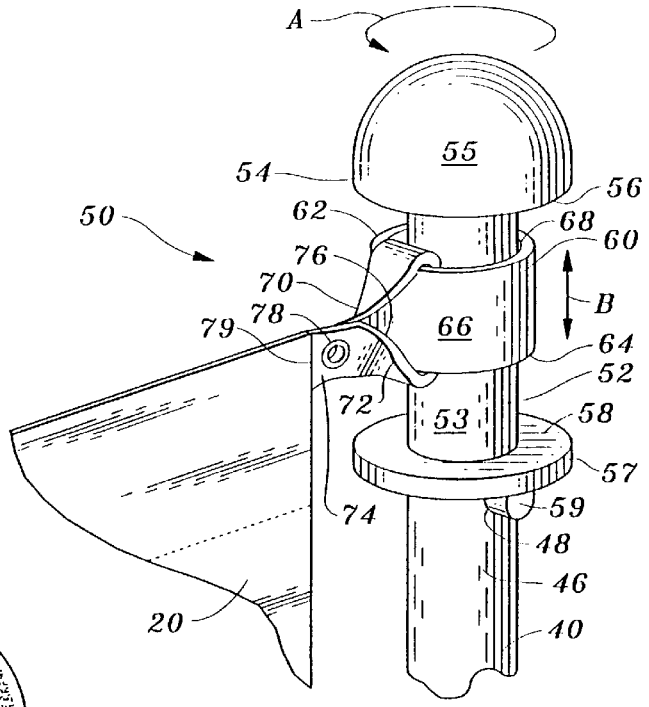
FIG. 2 is a perspective view providing a detail of a portion of that which is shown in FIG. 1, revealing a pivot assembly of the revolving pennant of this invention.
Figure 4:
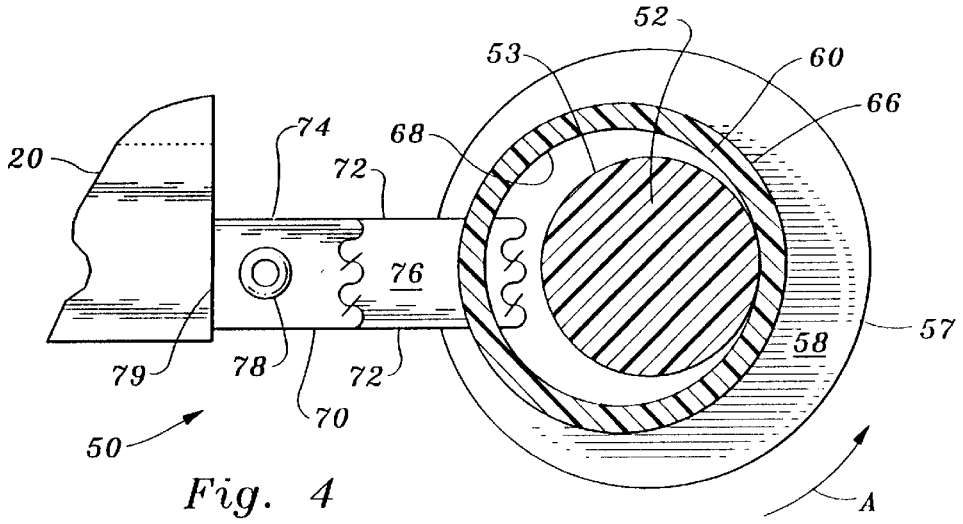
FIG. 4 is a full section view of that which is shown in FIG. 1, with the section taken along line 4—4 of FIG. 1 and revealing details of the pivot assembly of FIG. 2.

With particular reference to FIGS. 2–4, details of the pivot assembly 50 are described. The pivot assembly 50 provides a junction between the flag 20 and handle 40 which allows the flag 20 to revolve around the handle 40, along arrow A, without furling against the handle 40, but rather remaining free to revolve in either a clockwise or a counter clockwise direction indefinitely. The pivot assembly 50 includes an axle 52 which is generally cylindrical with a bearing surface 53 featured thereon. Preferably, the axle 52 is merely an extension above the upper end 46 of the handle 40 and has a diameter similar to the diameter of the cylindrical surface 42 of the handle 40.

A cap 54 is placed upon the axle 52. The cap 54 includes a convex surface 55 and a flat surface 56 facing the axle 52. The convex surface 55 is rounded to prevent sharp edges on the cap 54 and increasing the safety of the revolving pennant 10. The flat surface 56 faces downward and defines one end of the axle 52 about which the collar 60 is restrained. A disc 57 surrounds the handle 40 at a transition between the axle 52 and the upper end 46 of the handle 40. The disc 57 is generally circular with an annular surface 58 facing upwards and with a peg 59 oriented below the disc 57 and supporting the disc 57 in position. The peg 59 passes through a hole 48 passing through the handle 40 and is preferably cylindrical and glued in place and also glued to the disc 57 to keep the peg 59 and disc 57 rigidly in position adjacent the axle 52 and handle 40. The annular surface 58 of the disc 57 faces upwards and is generally parallel to the flat surface 56 of the cap 54. The flat surface 56 and annular surface 58 are spaced apart by a distance defining a length of the axle 52.

The pivot assembly 50 includes a collar 60 which is generally a hollow cylindrical tube with an upper edge 62 parallel to and spaced from a lower edge 64 and an outer surface 66 parallel to and spaced from an inner surface 68. The collar 60 exhibits a height between the upper edge 62 and lower edge 64 which is less than a distance between the flat surface 56 and the annular surface 58. The inner surface 68 of the collar 60 is preferably larger in diameter than the bearing surface 53 of the axle 52. Thus, the collar 60 can readily rotate and move up and down upon the axle 52 along arrow B. The inner surface 68 of the collar 60 has a diameter which is less than a 4 diameter of the cap 54 and the disc 57, such that the collar 60 cannot pass off of the axle 52. The collar 60 is thus free to move up and down between the cap 54 and the disc 57 and is free to rotate about the axle 52. However, the collar 60 is not free to be displaced away from the pivot assembly 50 and handle 40. Alternatively, in place of the collar 60 a hole could be provided through the flag 20 adjacent the handle 40. A ring with a diameter larger than the handle 40 and smaller than the cap 55 and the disc 57 could then be passed through the hole and around the handle 40 between the cap 55 and the disc 57, thus functioning as an attachment means to the handle 40. The hole can then be surrounded with a means for reinforcement, such as a rivet or a finishing seam of thread to prevent fraying or tearing of the flag 20 adjacent the hole.

A leash 70 is formed of preferably flexible fabric and includes side edges 72 which are preferably generally linear and an outside surface 74 parallel to and spaced from an inside surface 76. Preferably, the side edges 72 are parallel to each other such that the leash 70 is generally rectangular before it is folded into its position for use. The leash 70 is passed through the inner surface 68 of the collar 60 and folded back onto itself with the inner surface 68 thereof adjacent itself and then a rivet 78 is passed through the leash 70, causing the leash 70 to be securely attached to the collar 60. The leash 70 and collar 60 thus form the equivalent of lengths in a chain except the leash 70 is formed of flexible material and the collar 60 is formed from rigid material. The leash 70 is securely attached to the flag 20 through an attachment seam 79. The leash 70 thus provides one form of a means to attach the flag 20 to the collar 60 of the pivot assembly 50. Other attachment means, such as adhesives, fasteners and the like could similarly be used.

In use and operation, and with particular reference to FIG. 1, details of the operation of the revolving pennant 10 are described. When a fan F wishes to utilize the revolving pennant 10, the fan F first grasps the handle 40 of the revolving pennant 10 with the hand H adjacent the lower end 44 of the handle 40. The handle 40 is then revolved about arrow A, either clockwise or counter clockwise. This revolving of the handle 40 is preferably done in a manner which causes the upper end 46 of the handle 40 to trace a larger circular pathway than does the lower end 44 of the handle 40. As the upper end 46 of the handle 40 is caused to traverse this circular pattern, centrifugal forces cause the weight 34 in the weight region 30 of the flag 20 to extend away from the handle 40 to a position generally causing the flag 20 to be in a plane perpendicular to a long axis of the handle 40.

Because the collar 60 is not attached to the handle 40 but rather can pivot freely through the pivot assembly 50, the flag 20 can revolve around the handle 40 in a free manner. Because the flag 20 is formed of flexible material, slight differences in pressure between the front surface 22 and rear surface 24 will cause the flag 20 to ripple somewhat as it revolves around the handle 40, providing a noticeable and attractive appearance for the flag 20, but keeping the flag 20 sufficiently planar that indicia printed upon the flag 20 can be readily viewed by others. When the fan F wishes to cease operation of the revolving pennant 10, the fan F merely ceases to revolve the handle 40, causing the flag 20 to decelerate until it comes to rest.

Having thus described the invention it should now be apparent that various different modifications could be made to the revolving pennant of this invention without departing from the scope and fair meaning of the description included herein. For instance, while the weight region 30 is described as being along an upper edge of the flag 20, it could similarly be located further down along different portions of the perimeter 26 of the flag 20 or at various different locations upon the flag 20. Also, while the flag 20 is shown as generally being square or rectangular, the flag 20 could have a variety of different configurations, such as triangular, trapezoidal or forming a half or a fourth of a circle. While materials have been identified as being preferred in the construction of the revolving pennant 10, various different substitutions in materials for the handle and for the fabric or other materials utilized in forming the flag 20 could be resorted to without departing from the disclosure included herein. Also, orientations and configurations for seams upon the flag 20 and attaching the flag 20 to the pivot assembly 50 could be altered or replaced with other attachment structures, so long as the desired effect is maintained.

What is claimed is:

1. A hand held revolving pennant, comprising in combination:

an elongate handle having a lower end and an upper end opposite said lower end;

a flag, said flag formed of planar flexible fabric;

a means to pivotably attach said flag to said handle in a manner allowing said flag to revolve around said handle without furling;

a weight affixed to said flag at a location on said flag spaced from said pivotable attachment means, said weight having greater density than said fabric forming said flag;

wherein said weight is deformable when forces are applied thereto, such that impact forces exerted by said weight when said weight strikes another object are diminished;

wherein said weight includes an enclosure with multiple separate pellets located within said enclosure, said pellets restrained within said enclosure and capable of movement relative to adjacent said pellets within said enclosure;

wherein said weight is located at an edge of said flag opposite an edge of said flag where said pivotable attachment means connects said flag to said handle;

wherein a flexible reinforcement means extends from a weight region where said weight is located to an edge of said flag where said pivotable attachment means connects to said handle such that centrifugal forces generated between said pivotable attachment means and said weight are discouraged from damaging said fabric forming said flag;

wherein said pivotable attachment means includes a collar attached to said flag, said collar having an inner surface sized wider than a width of said handle at said upper end, said collar located surrounding said handle at said upper end with said inner surface facing said handle and means to restrain said collar from translating past said upper end of said handle and off of said handle;

wherein said means to restrain said collar from translating past said upper end of said handle and off of said handle includes a cap attached to said upper end of said handle, said cap including a convex surface on an uppermost end thereof and a flat surface adjacent said upper end of said handle and facing said collar, said flat surface having a diameter greater than a width of said upper end of said handle and greater than a diameter of said collar, said convex surface being substantially hemispherical and free of sharp edges;

wherein said collar is cylindrical in form with an inner diameter greater than a diameter of said handle, such that said collar can freely rotate about said handle, said collar being formed from a substantially rigid material;

wherein a disc surrounds said handle and extends radially from said handle at a location spaced from said upper end of said handle by a length of said handle defining an axle, said disc having a diameter greater than a diameter of said collar, said collar interposed between said flat surface of said cap and said disc;

wherein said flag is attached to said pivotable attachment means through a leash which attaches only to one corner of said flag, such that said flag can pivot into a plane non-parallel to said handle when said handle is oscillated in a manner causing said flag to rotate around said handle; and wherein said flag is square and said weight is restricted to one corner of said flag, said leash located at a corner linearly spaced along an edge of said flag from said weight, such that all of said flag is on a common side of a line extending between said leash and said weight.

* * * * *